US010188961B1

(12) United States Patent
Lee et al.

(10) Patent No.: US 10,188,961 B1
(45) Date of Patent: Jan. 29, 2019

(54) ASSEMBLY UNIT FOR TOY ASSEMBLY BLOCK

(71) Applicant: CREAMO Inc., Seoul (KR)

(72) Inventors: Seok Lee, Seoul (KR); Taikjin Lee, Seoul (KR); Jeong Hun Shin, Daegu (KR); Won Kyo Jeong, Daegu (KR); Sun Ho Kim, Seoul (KR); Hyunsoo Chung, Seoul (KR); Hyunduk Kim, Cheonan-si (KR); Yong-Joon Park, Seongnam-si (KR); Deokha Woo, Seoul (KR)

(73) Assignee: CREAMO INC., Seoul (KR)

( * ) Notice: Subject to any disclaimer, the term of this patent is extended or adjusted under 35 U.S.C. 154(b) by 0 days.

(21) Appl. No.: 15/889,155

(22) Filed: Feb. 5, 2018

(51) Int. Cl.
*A63H 33/08* (2006.01)
*A63H 33/06* (2006.01)

(52) U.S. Cl.
CPC ..... *A63H 33/086* (2013.01); *A63H 33/067* (2013.01); *A63H 33/084* (2013.01); *A63H 33/088* (2013.01)

(58) Field of Classification Search
CPC ..... A63H 33/04; A63H 33/06; A63H 33/062; A63H 33/08; A63H 33/084; A63H 33/086; A63H 33/088
See application file for complete search history.

(56) References Cited

U.S. PATENT DOCUMENTS 2,558,591 A * 6/1951 Starck ..... A63H 33/084 217/17
3,481,068 A * 12/1969 Paulson ..... A63H 33/088 446/128
3,924,376 A * 12/1975 Tsurumi ..... A63H 33/084 273/146
4,582,495 A * 4/1986 Orgass ..... A63H 33/088 446/102
5,215,490 A * 6/1993 Szoradi ..... A63H 33/08 446/115
5,273,477 A * 12/1993 Adams, Jr. ..... A63H 33/08 446/108
5,779,517 A * 7/1998 Clarke ..... A63H 33/044 446/108

(Continued)

FOREIGN PATENT DOCUMENTS

CN 201591980 U 9/2010
JP 2006-262939 A 10/2006
WO WO 01/03791 A1 1/2001

*Primary Examiner* — John Ricci
(74) *Attorney, Agent, or Firm* — Rabin & Berdo, P.C.

(57) ABSTRACT

An assembly unit includes a side plate having a plate shape and including a first coupling member on first side, a second coupling member on second side, and a third coupling member on each of third side and fourth side, a top plate having a plate shape and including a fourth coupling member on each side and a top stud on the top surface, and a bottom plate having a plate shape and including a fifth coupling member on each side and a bottom stud on the bottom surface. The first coupling member includes a protrusion. The second coupling member includes a groove. When the first coupling member of the side plate is engaged with the second coupling member of a neighboring side plate of the same type as the side plate, the protrusion of the side plate is fitted into the groove of the neighboring side plate.

7 Claims, 15 Drawing Sheets

(56) References Cited

U.S. PATENT DOCUMENTS

| | | | | | |
|---|---|---|---|---|---|
| 5,803,783 | A * | 9/1998 | Holmstrom | A63H 3/52 | 446/102 |
| 5,895,045 | A * | 4/1999 | Vilar | A63H 33/06 | 273/160 |
| 2002/0193046 | A1 * | 12/2002 | Zebersky | A63H 3/52 | 446/476 |

* cited by examiner

ASSEMBLY UNIT FOR TOY ASSEMBLY BLOCK

SPECIFIC REFERENCE TO A GRACE PERIOD INVENTOR DISCLOSURE

This invention has been published as Korean Patent Laid-Open Publication No. 10-2017-0013078 on Feb. 6, 2017, which is now Korean Patent No. 10-1714642.

BACKGROUND

1. Field

The present invention relates to an assembly unit for a toy assembly block.

2. Description of the Related Art

A self-assembly block toy set including a plurality of blocks of various shapes is used for various purposes. Such a self-assembly block toy set allows a user to make an arbitrary structure by assembling desired blocks. With the self-assembly block toy set, structures of various shapes can be created depending on imagination of the user, which can be used in a repeated manner by assembling and disassembling the blocks.

The activity of assembling the blocks to create the user's own structure stimulates creativity and imagination of the user, leading to an improvement of brain activity and intelligence of the user. In addition, as a more complicated structure can be made depending on design ability and imagination of the user, such a self-assembly block toy set is widely used not only for children of early childhood and preschool children but also for students and adults.

The self-assembly block toy set is designed to build a meaningful structure by coupling unit blocks in various directions. Therefore, a number of unit blocks of various sizes and shapes are required depending on the structure to be built.

In general, a self-assembly block toy set including unit blocks of fixed sizes and shapes virtually standardized is commercially available, or a set of unit blocks matching a specific structure is commercially available, such as LEGO®.

In this case, when a unit block of a desired size or shape is absent, the user needs to separately purchase a specific unit block to complete a desired structure. If the desired unit block is not sold separately or hard to purchase separately, the desired structure cannot be completed, which can limit the creativity and the imagination of the user.

Further, when a user wants to implement his or her own imagination by building a structure of an unknown shape, he or she may need a building block of non-standardized size and shape.

SUMMARY

According to some embodiments of the present invention, an assembly unit for a toy assembly block includes a side plate having a plate shape and including a first coupling member on a first side, a second coupling member on a second side, and a third coupling member on each of a third side and a fourth side, a top plate having a plate shape and including a fourth coupling member on each side and a top stud on a top surface, and a bottom plate having a plate shape and including a fifth coupling member on each side and a bottom stud on a bottom surface. The first coupling member of the side plate is configured to be engaged with the second coupling member of a neighboring side plate of a same type as the side plate. The fourth coupling member of the top plate is configured to be engaged with the third coupling member of the side plate. The fifth coupling member of the bottom plate is configured to be engaged with the third coupling member of the side plate. The first coupling member includes a protrusion. The second coupling member includes a groove. When the first coupling member of the side plate is engaged with the second coupling member of the neighboring side plate, the protrusion of the side plate is fitted into the groove of the neighboring side plate.

Further, according to some embodiments of the present invention, an assembly unit for a toy assembly block includes a side plate having a plate shape and including a first coupling member on a first side, a second coupling member on a second side, and a third coupling member on each of a third side and a fourth side, a top plate having a plate shape and including a fourth coupling member on each side and a top stud on a top surface, and a bottom plate having a plate shape and including a fifth coupling member on each side and a bottom stud on a bottom surface. The first coupling member of the side plate is configured to be engaged with the second coupling member of a neighboring side plate of a same type as the side plate. The fourth coupling member of the top plate is configured to be engaged with the third coupling member of the side plate. The fifth coupling member of the bottom plate is configured to be engaged with the third coupling member of the side plate. The third coupling member includes a pillar extending from the side plate and a hook formed at an end of the pillar. Each of the fourth coupling member and the fifth coupling member includes a hole. When the fourth coupling member of the top plate is engaged with the third coupling member of the side plate, the hook of the third coupling member is inserted into the hole of the fourth coupling member. When the fifth coupling member of the bottom plate is engaged with the third coupling member of the side plate, the hook of the third coupling member is inserted into the hole of the fifth coupling member.

Moreover, according to some embodiments of the present invention, an assembly unit for a toy assembly block includes a side plate having a plate shape and including a first coupling member on a first side, a second coupling member on a second side, and a third coupling member on each of a third side and a fourth side, a top plate having a plate shape and including a fourth coupling member on each side and a top stud on a top surface, and a bottom plate having a plate shape and including a fifth coupling member on each side and a bottom stud on a bottom surface. The first coupling member of the side plate is configured to be engaged with the second coupling member of a neighboring side plate of a same type as the side plate. The fourth coupling member of the top plate is configured to be engaged with the third coupling member of the side plate. The fifth coupling member of the bottom plate is configured to be engaged with the third coupling member of the side plate. The third coupling member includes a thread. Each of the fourth coupling member and the fifth coupling member includes a thread corresponding to the thread of the third coupling member. The fourth coupling member and the fifth coupling member are configured to be engaged with the third coupling member in a screwed manner using the threads.

Further, according to some embodiments of the present invention, an assembly unit for a toy assembly block includes a side plate having a plate shape and including a first coupling member on a first side, a second coupling member on a second side, and a third coupling member on each of a third side and a fourth side, a top plate having a plate shape and including a fourth coupling member on each side and a top stud on a top surface, and a bottom plate having a plate shape and including a fifth coupling member on each side and a bottom stud on a bottom surface. The first coupling member of the side plate is configured to be engaged with the second coupling member of a neighboring side plate of a same type as the side plate. The fourth coupling member of the top plate is configured to be engaged with the third coupling member of the side plate. The fifth coupling member of the bottom plate is configured to be engaged with the third coupling member of the side plate. Each of the fourth coupling member and the fifth coupling member includes a protrusion. The third coupling member includes a rail structure to guide the protrusion. The fourth coupling member and the fifth coupling member are configured to be engaged with the third coupling member by sliding the protrusion through the rail structure.

The above and other objects, features, advantages and technical and industrial significance of this invention will be better understood by reading the following detailed description of presently preferred embodiments of the invention, when considered in connection with the accompanying drawings.

BEST MODE(S) FOR CARRYING OUT THE INVENTION

Figure 1:
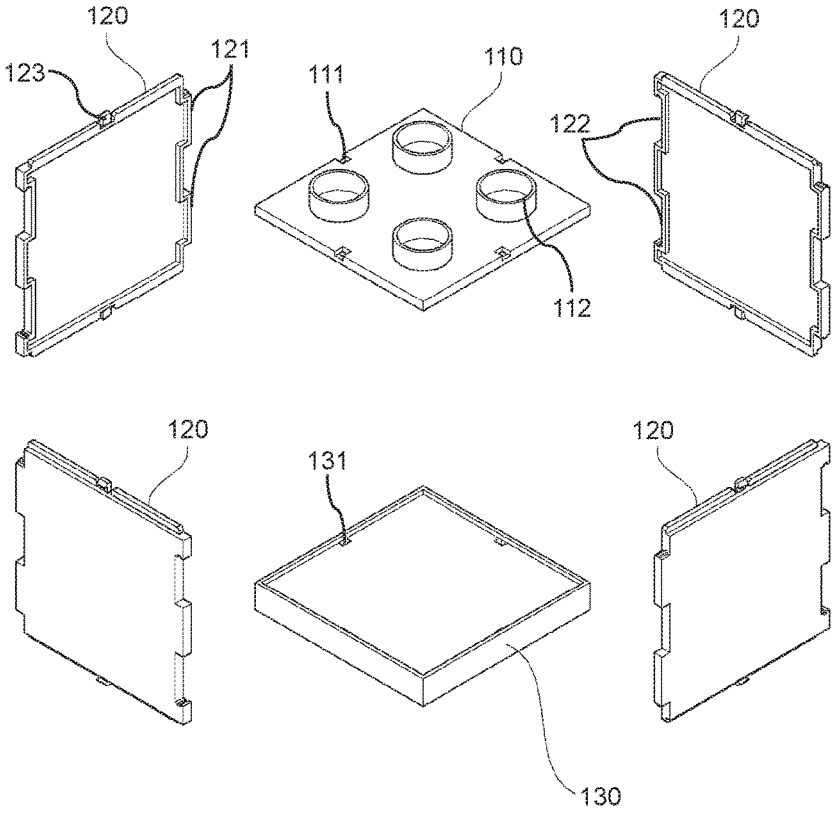
FIG. 1 is an exploded perspective view of an assembly unit for a toy assembly block according to some embodiments of the present invention.

Exemplary embodiments of the present disclosure are described in detail below with reference to the accompanying drawings. In the following descriptions, like reference numerals designate like elements although the elements are shown in different drawings. Further, detailed descriptions of known functions and configurations incorporated herein are omitted for the purpose of clarity and for brevity.

Figure 2:
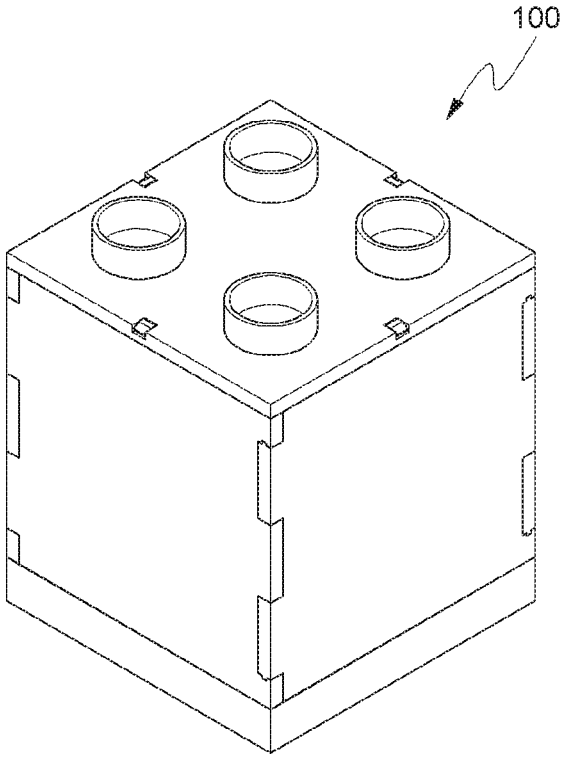
FIG. 2 is a perspective view of an assembled assembly unit shown in FIG. 1.
Figure 3:
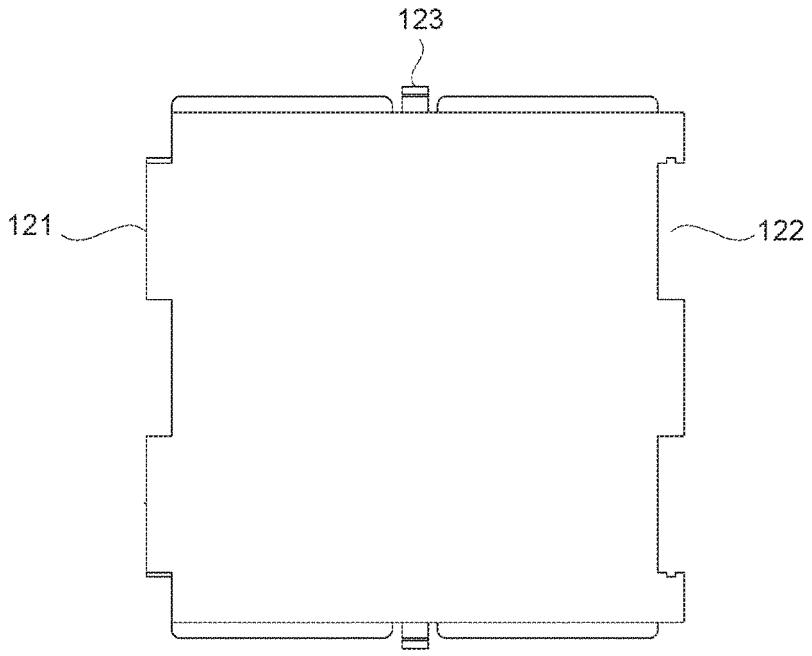
FIG. 3 is a front view of a side plate shown in FIG. 1.

FIG. 1 is an exploded perspective view of an assembly unit 100 for a toy assembly block according to some embodiments of the present invention, FIG. 2 is a perspective view of the assembly unit 100 in an assembled state, and FIG. 3 is a front view of a side plate of the assembly unit 100.

As shown in FIGS. 1 and 2, the assembly unit 100 according to some embodiments of the present invention includes a side plate 120 having a plate shape and including a first coupling member 121 provided on a first side (the left side in the example shown in FIG. 3), a second coupling member 122 provided on a second side (the right side in the example shown in FIG. 3), and third coupling members 123 respectively provided on a third side (the top side in the example shown in FIG. 3) and a fourth side (the bottom side in the example shown in FIG. 3), a top plate 110 having a plate shape and including a fourth coupling member 111 provided on each side and a top stud 112 provided on a top surface, and a bottom plate 130 having a plate shape and including a fifth coupling member 131 provided on each side and a bottom stud (1133 in FIG. 11) provided on a bottom surface.

The first coupling member 121 of one side plate 120 is engaged with the second coupling member 122 of a neighboring side plate 120 to couple two side plates 120. When four side plates 120 are coupled to form four sides of a hexahedron, the fourth coupling member 111 of the top plate 110 is engaged with the third coupling member 123 on the top side of the side plate 120 and the fifth coupling member 131 of the bottom plate 130 is engaged with the third coupling member 123 on the bottom side of the side plate 120 to complete the hexahedron.

Although a hexahedron including the top plate 110, the bottom plate 130, and four side plates 120 are described in FIGS. 1 to 3 as an example, the number of plates is not limited to this example but can be selected as appropriate depending on the size or the shape of structure to form. Further, the shapes of the top plate 110 and the bottom plate 130 are not limited to a polygon but can be circular or elliptical as appropriate. When the shapes of the top plate 110 and the bottom plate 130 are circular or elliptical, the side plate 120 has an arc along the circumferences of the top plate 110 and the bottom plate 130 to form a cylindrical block.

The assembly unit 100 can be assembled and disassembled as appropriate to form blocks of different sizes and different shapes depending on the structure to be built.

The side plates 120 are coupled with each other to form sides of a polyhedron or a cylindrical shape. Although the side plate 120 is shown in the drawings as a solid plate, in some embodiments of the present invention, the side plate 120 is a side frame such that a functional unit can be fitted into the side frame to exhibit various functions on the side plate 120.

The top plate 110 defines the top surface of the assembly unit 100 when a polyhedron is formed. The size and the shape of the top plate 110, the number of top studs 112, and the layout of the top studs 112 can be determined depending on the size and the shape of the assembly unit 100.

The bottom plate 130 defines the bottom surface of the assembly unit 100 when a polyhedron is formed. The size and the shape of the bottom plate 130, the number of bottom studs (1133 in FIG. 11), and the layout of the bottom studs (1133 in FIG. 11) can be determined depending on the size and the shape of the assembly unit 100.

As shown in FIG. 3, the first coupling member 121 is formed of at least one protrusion on the first side, and the second coupling member 122 is formed of at least one recessed portion on the second side corresponding to the first coupling member 121. In the example shown in FIG. 3, two first coupling members 121 are formed on the first side, and two second coupling members 122 respectively corresponding to the two first coupling members 121 are formed on the second side. However, the number of first coupling members 121 and the number of corresponding second coupling members 122 can be set as appropriate.

The first coupling member 121 of the side plate 120 is engaged with the second coupling member 122 of a neighboring side plate 120, and the number of side plates 120 coupled in this manner determines the shapes of the top plate 110 and the bottom plate 130.

Figure 4:
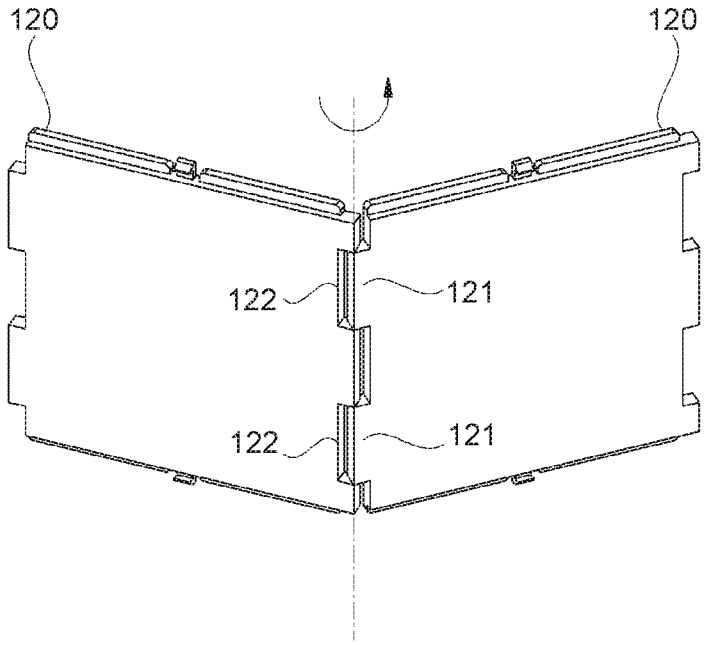
FIG. 4 is a front view of two side plates coupled with each other according to some embodiments of the present invention.

FIG. 4 is a front view of two side plates 120 coupled with each other according to some embodiments of the present invention. In FIG. 4, the first coupling member 121 of the side plate 120 on the right side in FIG. 4 is engaged with the second coupling member 122 of the neighboring side plate 120 on the left side in FIG. 4. In this state, the side plate 120 and the neighboring side plate 120 can be rotatably coupled along the coupling center axis. For example, the side plate 120 and the neighboring side plate 120 can be rotatably coupled to make an angle of 30 degrees to 180 degrees.

Figure 5:
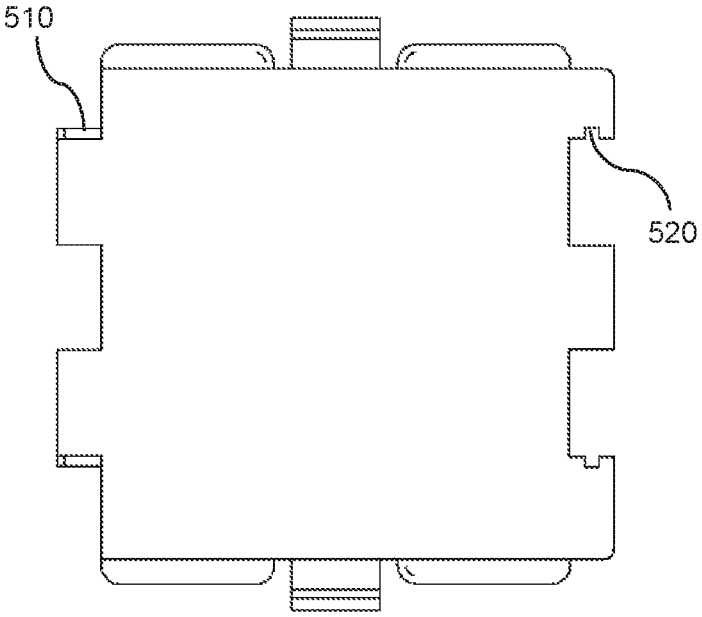
FIG. 5 is a front view of the side plate including a coupling assist unit for coupling neighboring side plates according to some embodiments of the present invention.

In some embodiments of the present invention, two side plates 120 need to be coupled in a fixed manner instead of being rotatably coupled with each other. FIG. 5 shows a coupling assist unit including a protrusion 510 on the first coupling member 121 and a groove 520 on the second coupling member 122 for coupling neighboring side plates 120 according to some embodiments of the present invention.

Figure 6:
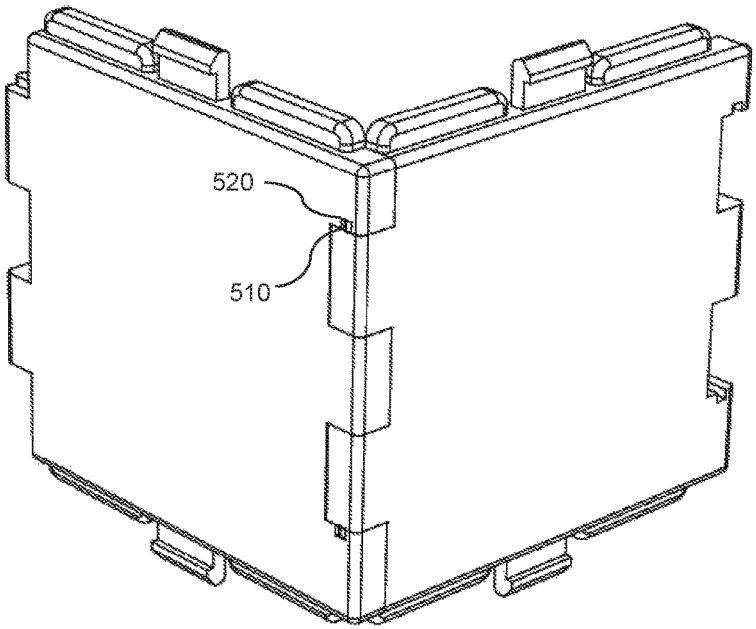
FIG. 6 is a front view of two side plates with the coupling assist unit coupled with each other according to some embodiments of the present invention.

FIG. 6 shows two side plates coupled with each other with the protrusion 510 of one side plate (on the right side) fitted into the groove 520 of the other side plate (on the left side). With the protrusion 510 of one side plate fitted into the groove 520 of the other side plate, the two side plates 120 are coupled with each other in a fixed manner at a fixed angle.

Figure 7:
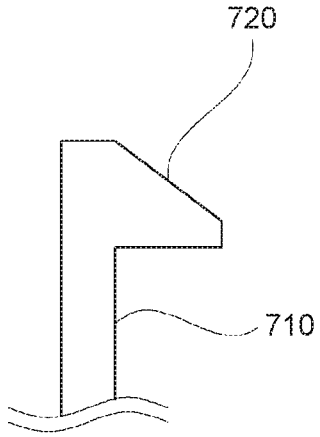
FIG. 7 is a schematic diagram for illustrating a second coupling element of a side plate according to some embodiments of the present invention.

FIG. 7 is a schematic diagram for illustrating the third coupling member 123 of the side plate 120 according to some embodiments of the present invention. As shown in FIG. 7, the third coupling member 123 includes a pillar 710 extending from the third side or the fourth side of the side plate 120 and a hook 720 formed at the end of the pillar 710. Although the hook 720 extended from the pillar in one direction is shown in FIG. 7, in some embodiments of the present invention, the hook 720 is formed to extend in every direction, such as a shape of a mushroom.

The fourth coupling member 111 of the top plate 110 and the fifth coupling member 131 of the bottom plate 130 includes a hole into which the hook 720 of the side plate 120 is inserted and locked. The shape of the hole can be square or circular.

Figure 8:
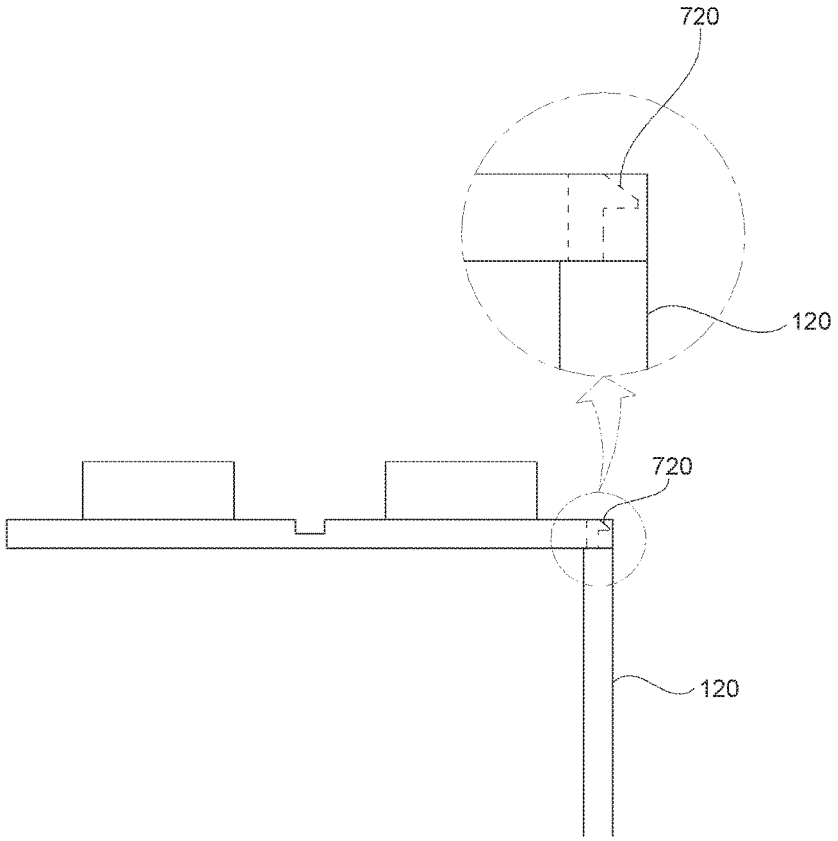
FIGS. 8 and 9 are schematic diagrams for illustrating coupling between a side plate and a top plate according to some embodiments of the present invention.
Figure 9:
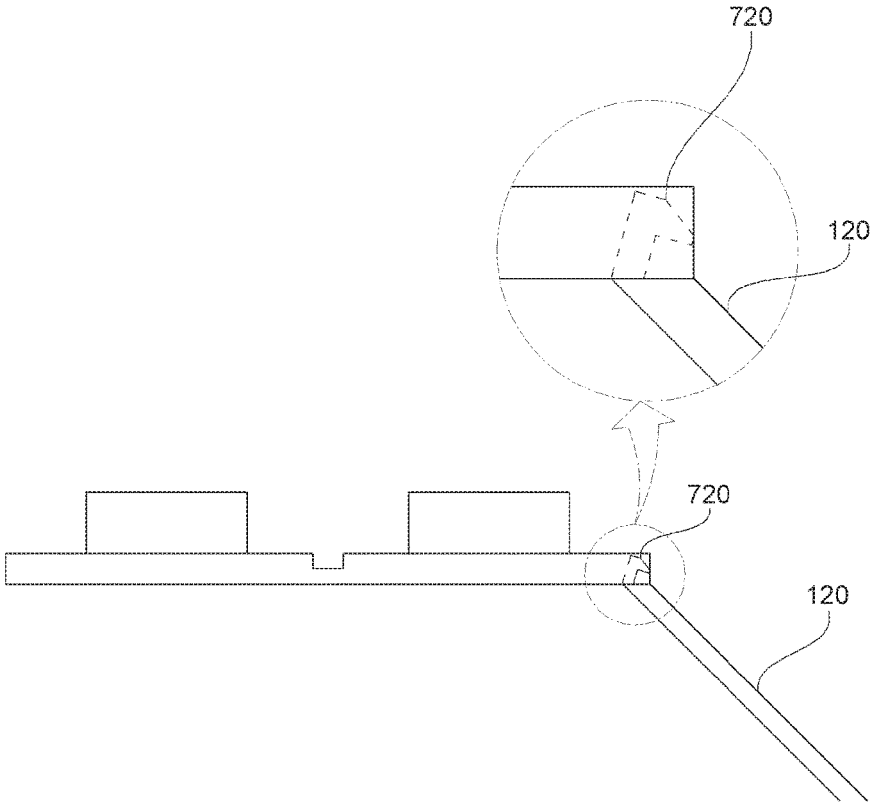

FIGS. 8 and 9 are schematic diagrams for illustrating coupling between the side plate 120 and the top plate 110 according to some embodiments of the present invention. As shown in FIG. 8, the hook 720 is formed extending from the third side of the side plate 120 and inserted into the fourth coupling member 111 of the top plate 110. The top plate 110 and the side plate 120 are then coupled with each other making 90 degrees of internal angle.

In FIG. 9, the hook 720 is formed to make a predetermined angle with the side plate 120, and when the hook 720 is inserted into the fourth coupling member 111, the top plate 110 and the side plate 120 are coupled in a manner that an angle between the top plate 110 and the side plate 120 becomes larger than 90 degrees.

Figure 10:
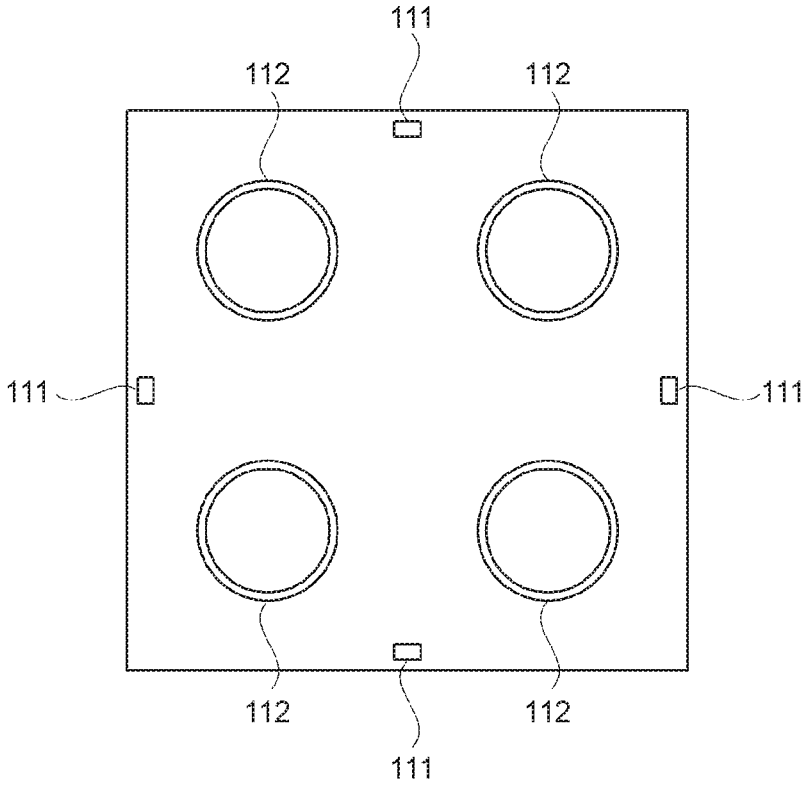
FIG. 10 is a top view of a top plate according to some embodiments of the present invention.

FIG. 10 is a top view of the top plate 110 according to some embodiments of the present invention. As shown in FIG. 10, the top plate 110 has a plate shape (polygonal, circular, or elliptical), including the fourth coupling member 111 on each side and the top stud 112 on the top surface.

The size and the shape of the top plate 110, the number of top studs 112, and the layout of the studs 112 can be determined depending on the shape of the assembly unit 100 to be formed. In the example shown in FIG. 10, the top plate 110 has a square plate shape on which four studs 112 are arranged.

The top plate 110 includes the fourth coupling member 111 on each side in the form of a square or circular (including elliptical) hole. The number of fourth coupling members 111 is set to be at least same as the number of third coupling members 123.

Figure 11:
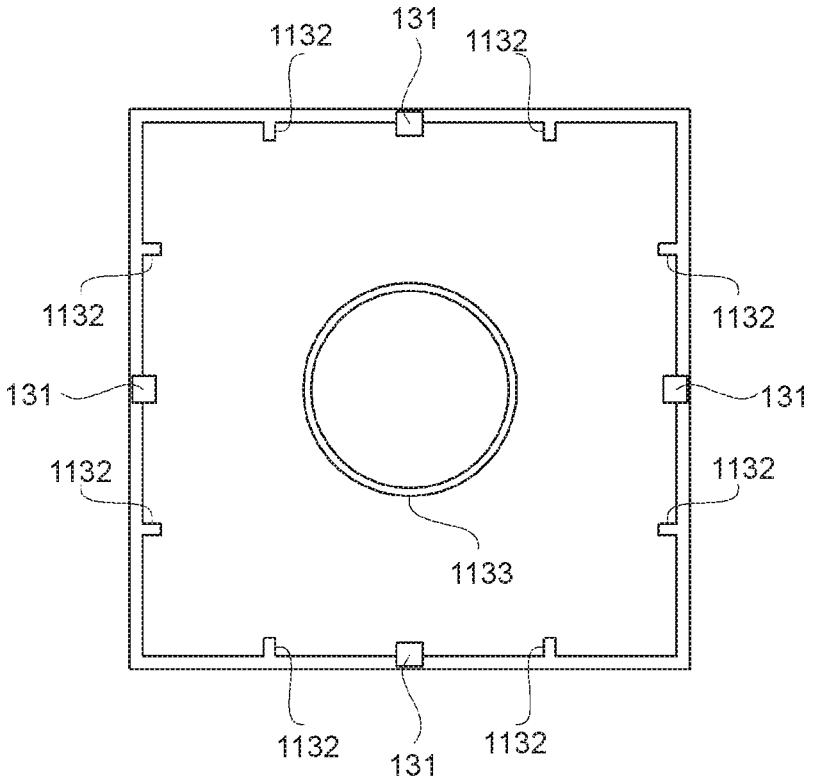
FIG. 11 is a bottom view of a bottom plate according to some embodiments of the present invention.

FIG. 11 is a bottom view of the bottom plate 130 according to some embodiments of the present invention. As shown in FIG. 11, the bottom plate 130 has a plate shape (polygonal, circular, or elliptical), including the fifth coupling member 131 on each side and a support mechanism for supporting the top stud 112 of the top plate 110 on the bottom surface. The support mechanism includes the bottom stud 1133 and protrusions 1132 formed on the sides of the bottom plate 130.

The size and the shape of the bottom plate 130 and the support mechanism can be determined depending on the shape of the assembly unit 100 to be formed. In the example shown in FIG. 11, the support mechanism includes the bottom stud 1133 at the center and a pair of protrusions 1132 at each corner.

The bottom plate 130 includes the fifth coupling member 131 on each side in the form of a square or circular (or elliptical) hole. The number of fifth coupling members 131 is set to be at least same as the number of third coupling members 123.

Figure 12:
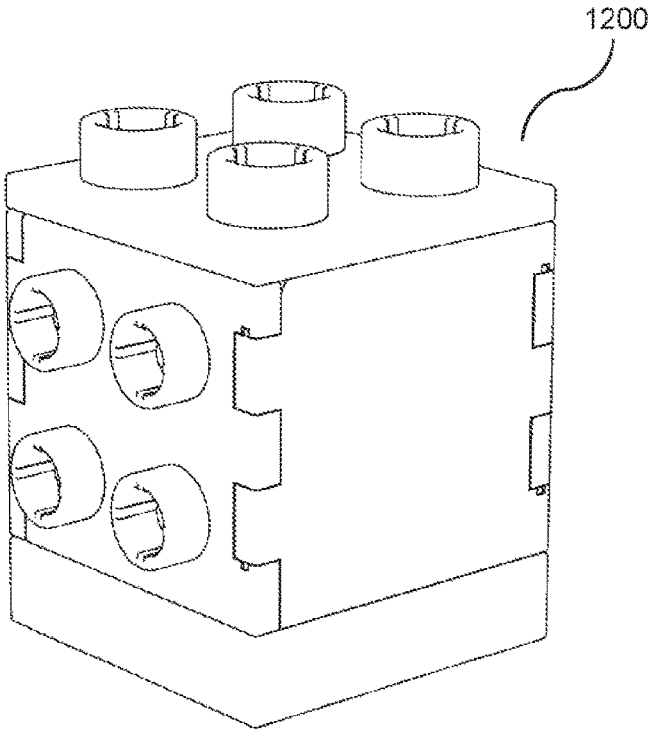
FIG. 12 is a perspective view of the assembly unit with a side plate having the top stud on the front surface for lateral coupling according to some embodiments of the present invention.
Figure 13:
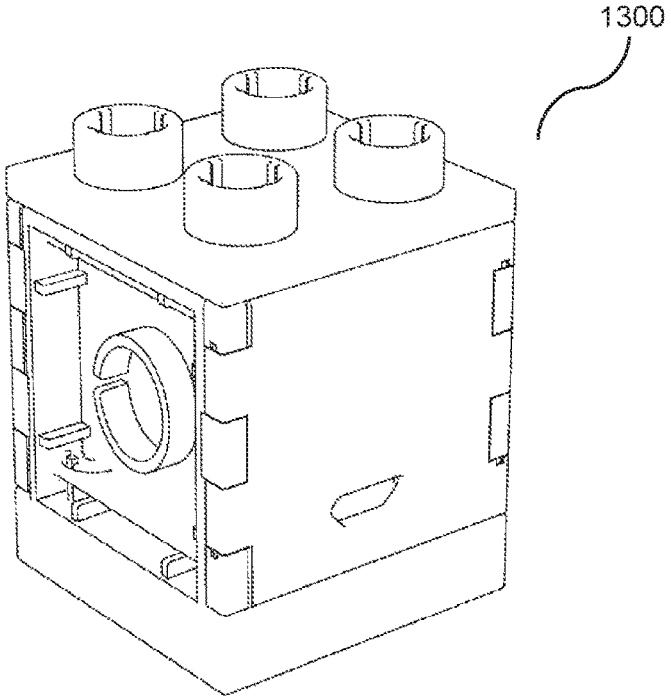
FIG. 13 is a perspective view of the assembly unit with a side plate having the bottom stud on the front surface for lateral coupling according to some embodiments of the present invention.

FIG. 12 is a perspective view of an assembly unit 1200 with a side plate having a top stud on the front surface for lateral coupling according to some embodiments of the present invention, and FIG. 13 is a perspective view of an assembly unit 1300 with a side plate having a bottom stud on the front surface for lateral coupling according to some embodiments of the present invention.

With the assembly unit 1200 and the assembly unit 1300 the stacking direction can be changed by 90 degrees, providing the flexibility in building more complicated structure.

Figure 14:
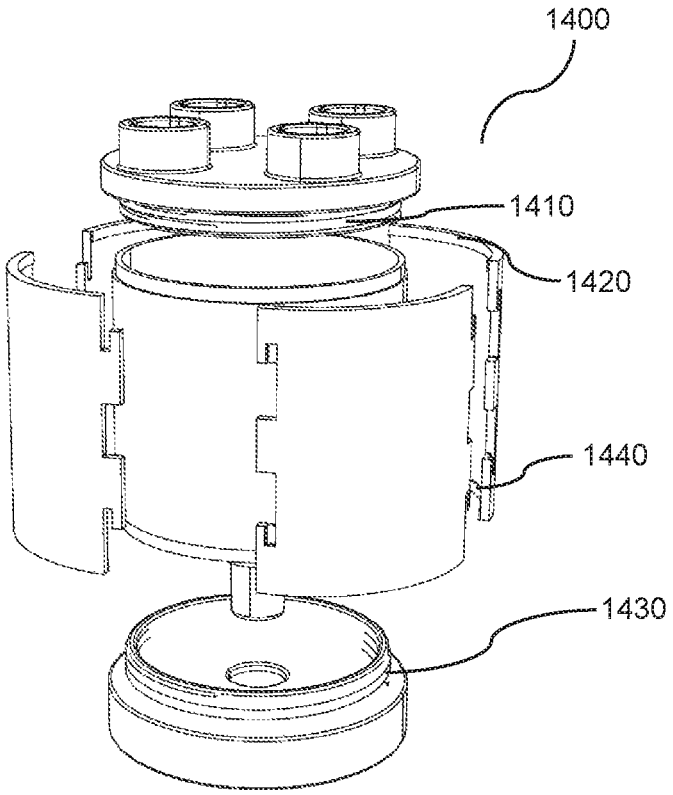
FIG. 14 is an exploded perspective view of an assembly unit of a cylindrical shape with top and bottom plates fixed in a screwed manner according to some embodiments of the present invention.

FIG. 14 is an exploded perspective view of an assembly unit 1400 of a cylindrical shape with top and bottom plates fixed in a screwed manner according to some embodiments of the present invention.

As shown in FIG. 14, the assembly unit 1400 includes a thread 1410 on the top plate and a thread 1420 on side plates at positions corresponding to the thread 1410. When all side plates are coupled to form the side wall of a cylinder, the top plate can be coupled in a screwed manner using the thread 1410 and the thread 1420.

Similarly, the bottom plate of the assembly unit 1400 includes a thread 1430 and the side plate includes a thread 1440. When all side plates are coupled to form the side wall of a cylinder, the bottom plate can be coupled in a screwed manner using the thread 1430 and the thread 1440.

In some embodiments, the top and bottom plates includes a protrusion (not shown) on at least a pair of edges facing each other and at least two side plates facing each other include a rail structure to guide the protrusion of the top and bottom plates. When all side plates are coupled to form the side wall of a hexahedron, the top and bottom plates can be coupled by sliding the protrusion through the rail structure of the side plates.

Figure 15:
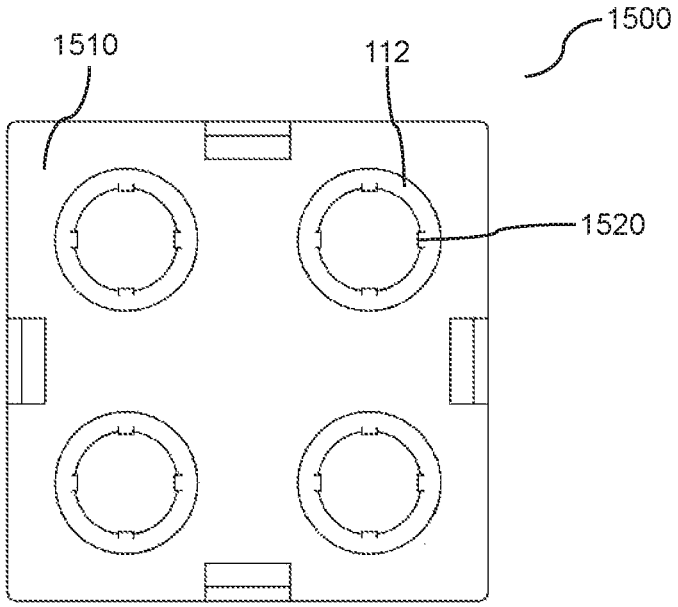
FIG. 15 is a top view of a top plate with an internal protrusion according to some embodiments of the present invention.

FIG. 15 is a top view of an assembly unit 1500 including a top plate 1510 with an internal protrusion 1520 according to some embodiments of the present invention.

When a relatively small block or a shallow block needs to be stacked on the assembly unit 1500 it may not be possible to stably stack the small or shallow block. The internal protrusion 1520 reduces the effective inner diameter of the top stud 112 such that a bottom stud of a smaller diameter can be stably fitted into the top stud 112.

Further, the screw structure of the top and bottom plates of the assembly unit 1400 can be applied to the front of the side plate in a protruded manner. Two neighboring assembly units both having the screw structure on any one of the side plates then can be coupled laterally in a screwed manner.

The present invention should not be limited to the above-mentioned embodiments but various changes and modifications can be made by a person having ordinarily skill in the art within the subject matter, the spirit and scope of the present invention as hereinafter claimed. Specific terms in the specification and drawings are used for illustrative purposes and not to be considered as limitations of the present invention. Exemplary embodiments of the present invention have been described for the sake of brevity and clarity. Accordingly, a person having ordinary skill in the art would understand the scope of the claimed invention is not to be limited by the above-mentioned embodiments but by the claims and equivalents thereof.

What is claimed is:

1. An assembly unit for a toy assembly block, the assembly unit comprising:

a side plate having a plate shape and including a first coupling member on a first side, a second coupling member on a second side, and a third coupling member on each of a third side and a fourth side;

a top plate having a plate shape and including a fourth coupling member on each side and a top stud on a top surface; and a bottom plate having a plate shape and including a fifth coupling member on each side and a bottom stud on a bottom surface, wherein the first coupling member of a side plate is configured to be engaged with the second coupling member of a neighboring side plate of a same type as the side plate, the fourth coupling member of the top plate is configured to be engaged with the third coupling member of the side plate, the fifth coupling member of the bottom plate is configured to be engaged with the third coupling member of the side plate, the first coupling member includes a protrusion, the second coupling member includes a groove, when the first coupling member of the side plate is engaged with the second coupling member of the neighboring side plate, the protrusion of the side plate is fitted into the groove of the neighboring side plate, the third coupling member includes a pillar extending from the side plate and a hook formed at an end of the pillar, each of the fourth coupling member and the fifth coupling member includes a hole, when the fourth coupling member of the top plate is engaged with the third coupling member of the side plate, the hook of the third coupling member is inserted into the hole of the fourth coupling member, and when the fifth coupling member of the bottom plate is engaged with the third coupling member of the side plate, the hook of the third coupling member is inserted into the hole of the fifth coupling member.

2. An assembly unit for a toy assembly block, the assembly unit comprising:

a side plate having a plate shape and including a first coupling member on a first side, a second coupling member on a second side, and a third coupling member on each of a third side and a fourth side;

a top plate having a plate shape and including a fourth coupling member on each side and a top stud on a top surface;

a bottom plate having a plate shape and including a fifth coupling member on each side and a bottom stud on a bottom surface; and an internal protrusion inside the top stud, wherein the first coupling member of a side plate is configured to be engaged with the second coupling member of a neighboring side plate of a same type as the side plate, the fourth coupling member of the top plate is configured to be engaged with the third coupling member of the side plate, the fifth coupling member of the bottom plate is configured to be engaged with the third coupling member of the side plate, the first coupling member includes a protrusion, and the second coupling member includes a groove, when the first coupling member of the side plate is engaged with the second coupling member of the neighboring side plate, the protrusion of the side plate is fitted into the groove of the neighboring side plate.

3. An assembly unit for a toy assembly block, the assembly unit comprising:

a side plate having a plate shape and including a first coupling member on a first side, a second coupling member on a second side, and a third coupling member on each of a third side and a fourth side;

a top plate having a plate shape and including a fourth coupling member on each side and a top stud on a top surface; and a bottom plate having a plate shape and including a fifth coupling member on each side and a bottom stud on a bottom surface, wherein the first coupling member of the side plate is configured to be engaged with the second coupling member of a neighboring side plate of a same type as the side plate, the fourth coupling member of the top plate is configured to be engaged with the third coupling member of the side plate, the fifth coupling member of the bottom plate is configured to be engaged with the third coupling member of the side plate, the third coupling member includes a pillar extending from the side plate and a hook formed at an end of the pillar, each of the fourth coupling member and the fifth coupling member includes a hole, when the fourth coupling member of the top plate is engaged with the third coupling member of the side plate, the hook of the third coupling member is inserted into the hole of the fourth coupling member, and when the fifth coupling member of the bottom plate is engaged with the third coupling member of the side plate, the hook of the third coupling member is inserted into the hole of the fifth coupling member.

4. The assembly unit according to claim 3, wherein the first coupling member includes a protrusion, the second coupling member includes a groove, and when the first coupling member of the side plate is engaged with the second coupling member of the neighboring side plate, the protrusion of the side plate is fitted into the groove of the neighboring side plate.

5. The assembly unit according to claim 3, wherein the third coupling member includes a thread, each of the fourth coupling member and the fifth coupling member includes a thread corresponding to the thread of the third coupling member, and the fourth coupling member and the fifth coupling member are configured to be engaged with the third coupling member in a screwed manner using the threads.

6. The assembly unit according to claim 3, wherein each of the fourth coupling member and the fifth coupling member includes a protrusion, the third coupling member includes a rail structure to guide the protrusion, and the fourth coupling member and the fifth coupling member are configured to be engaged with the third coupling member by sliding the protrusion through the rail structure.

7. The assembly unit according to claim 3, further comprising an internal protrusion inside the top stud.

* * * * *